US005473351A

United States Patent [19]

Helterline et al.

[11] Patent Number: 5,473,351

[45] Date of Patent: Dec. 5, 1995

[54] METHOD AND APPARATUS FOR REGULATING PRINT DENSITY IN AN INK-JET PRINTER

[75] Inventors: Brian L. Helterline, Salem; John H. Dion, Corvallis; Michael D. Whitmarsh, Tigard, all of Oreg.

[73] Assignee: Hewlett-Packard Corporation, Palo Alto, Calif.

[21] Appl. No.: 291,317

[22] Filed: Aug. 15, 1994

Related U.S. Application Data

[63] Continuation of Ser. No. 881,447, May 11, 1992, abandoned.

[51] Int. Cl.[6] ..... B41J 29/393

[52] U.S. Cl. ..... 347/19; 347/16

[58] Field of Search ..... 347/5, 9, 10, 14, 347/19, 16; 346/134

[56] References Cited

U.S. PATENT DOCUMENTS

| | | | |
|---|---|---|---|
| 4,328,504 | 5/1982 | Weber et al. | 347/14 |
| 4,339,762 | 7/1982 | Shirato et al. | 347/62 |
| 4,435,674 | 3/1984 | Hevenor et al. | 347/14 |
| 4,449,052 | 5/1984 | Krieg | 250/568 |
| 4,907,013 | 3/1990 | Hubbard et al. | 346/140 R X |
| 4,967,212 | 10/1990 | Manabe et al. | 346/160 |
| 5,289,208 | 2/1994 | Haselby | 347/19 |
| 5,319,421 | 6/1994 | West | 347/19 |

FOREIGN PATENT DOCUMENTS

| | | |
|---|---|---|
| 186651 | 7/1986 | European Pat. Off. . |
| 449403 | 10/1991 | European Pat. Off. . |
| 461759 | 12/1991 | European Pat. Off. . |
| 53-42031 | 4/1978 | Japan . |
| 58-162350 | 9/1983 | Japan . |
| 61-283557 | 12/1986 | Japan . |

OTHER PUBLICATIONS

Patent Abstract of Japan Patent No. 3284767 to Akihiko, issued Dec. 1991, filed Mar. 30, 1990.

*Primary Examiner*—Benjamin R. Fuller
*Assistant Examiner*—John E. Barlow, Jr.

[57] ABSTRACT

Method and apparatus for regulating print density in a printer of the type of an ink-jet printer having a print cartridge including nozzles which each fire ink therefrom responsive to a voltage pulse applied to a resistor in the nozzle. An optical sensor senses line width printed by the nozzles. Circuitry determines the difference between a predetermined optimum line width and the printed line width. Look-up tables relate the line width to the energy of a pulse applied to each resistor and use this signal to control ink drop volume, and therefore printed dot size. In another embodiment, a nozzle includes 2400 addressable nozzles per inch. Sensed line width is used to vary the dpi by selecting different ones of the nozzles for firing thereby maintaining appropriate relative positioning of the dots when their size varies from the predetermined line width. In the direction of paper movement, the speed of a paper carrier is varied to match the printing frequency of the X-axis to produce square images.

18 Claims, 3 Drawing Sheets

ON GILBERT BOND

ON MYLAR

ON MYLAR

METHOD AND APPARATUS FOR REGULATING PRINT DENSITY IN AN INK-JET PRINTER

CROSS REFERENCE TO RELATED APPLICATION

This is a continuation of application Ser. No. 07/881,447 filed on May 11, 1992, now abandoned.

BACKGROUND OF THE INVENTION

1. Field of the Invention

The present invention relates generally to methods and apparatus for regulating print density in an ink-jet printer and more particularly to such a method and apparatus which utilizes an optical sensor for measuring printed line width.

2. Description of the Related Art

Ink-jet printers include a print cartridge having a plurality of nozzles which can print rows of dots. Print media, such as paper, moves along a media scan axis beneath the nozzles which fire ink therefrom to print images on the paper. In some cases, the print cartridge is mounted on a carriage for bidirectional movement across the paper orthogonal to the axis of media movement. In others, the print cartridge is as wide as the print media with the only movement during printing being that of the paper relative to the cartridge.

As used herein, the term Y-axis refers to the axis of paper movement and the term X-axis refers to an axis which is in the same plane and at 90° to the Y-axis. For a printer having a movable print carriage, the carriage moves back and forth along the X-axis. The separation of ink-jet nozzles on the print cartridge in the X-axis direction typically corresponds to the desired resolution (e.g., 1/300th of an inch for 300 dot per inch (dpi) resolution). Resolution along the Y-axis is determined by the frequency of ink-jet nozzle firing and by the speed of paper movement along the Y-axis. To obtain 300 dpi resolution at a frequency of nozzle firing of 3.6 kilohertz, paper must move along the Y-axis under the print cartridge at 12 inches per second.

A typical ink-jet print cartridge includes a plurality of nozzles each having an associated resistor therein. A supply of ink feeds each of the nozzles. When voltage is applied across selected ones of the resistors, the resistor heats ink in the nozzle and ejects a drop of ink from the end of the nozzle and onto the paper moving beneath the print cartridge.

Most prior art ink-jet print cartridges are designed to eject a drop of substantially constant volume for varying voltage pulse energies applied to a nozzle resistor. In other words, the width and magnitude of a voltage pulse applied to a nozzle resistor does not have a substantial effect on the volume of a drop of ink ejected from the nozzle.

There is a prior art patent, U.S. Pat. No. 4,339,762 to Shirato et al., for a liquid jet recording method in which resistors in a print cartridge are designed so that the volume of a drop of ink ejected from the nozzle varies in response to the voltage pulse energy applied to the resistor. Thus, the diameter of a dot of ink from a nozzle which strikes the print media can be varied by varying the voltage pulse energy applied to the nozzle resistor. Therefore, the width of a line printed by such a printer can be made to vary by varying the energy of the voltage pulses applied to the nozzle resistors. This is true of a line comprising a single row of dots generated by ink drops ejected from a corresponding row of nozzles and of a wider line comprised of a plurality of such rows printed adjacent one another.

The size of a printed dot may also vary depending upon several other factors. Different types of paper absorb the ink differently. In some cases printing is done on a polyamide sheet which does not absorb ink at all and thus produces a very large dot and correspondingly wide lines. In addition, ink-drop volume can vary depending upon the ambient temperature and humidity thereby varying the size of the dot made by the drop.

In a 300 dpi printer, the minimum width of a line made up of a single row of printed dots is approximately 120 microns. As noted, variations in print media and ambient temperature and humidity can create variations in the dot size and therefore the width of a line. It would be desirable to control print density by changing dot size and/or by varying the location of dots printed on the paper to maintain resolution.

SUMMARY OF THE INVENTION

A method for regulating print density in a printer of the type having a plurality of nozzles which are each associated with a resistor that causes an ink drop to be fired from its associated nozzle responsive to voltage applied thereto. First, a predetermined line width is selected. Print media is positioned opposite the nozzles and a line is printed thereon by applying a voltage pulse to selected ones of the resistors. The line width is sensed and the difference between the predetermined line width and the printed line width is determined. The density of the ink printed on the print media is varied in a manner which tends to control the print density in a manner which improves resolution. Apparatus is also provided for performing the method.

The present invention provides a method and apparatus for regulating ink-jet printer print density to optimize resolution.

DETAILED DESCRIPTION OF THE PREFERRED EMBODIMENTS

Figure 1:
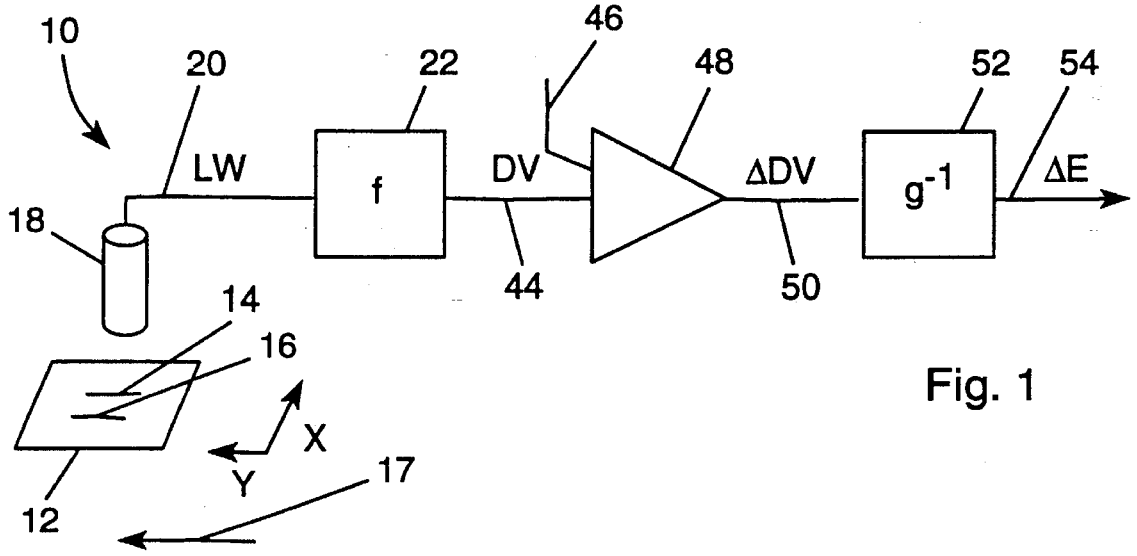
FIG. 1 is a schematic diagram of a portion of a first embodiment of the present invention.

Turning now to FIG. 1, illustrated generally at 10 is a schematic of a portion of a printer constructed in accordance with the present invention. Illustrated therein is a piece of paper supported on a conventional mechanism (not shown) for moving paper past a print cartridge in an ink-jet printer. Paper 12 includes lines 14, 16 printed thereon by a cartridge (also not shown) of the type disclosed in U.S. Pat. No. 4,339,762 to Shirato et al. for a liquid jet recording method, which is incorporated herein by reference. The cartridge includes a plurality of nozzles having resistors incorporated therein which causes a drop of ink to be ejected from each nozzle when voltage is applied to the resistor associated with the nozzle. Moreover, when the energy of a voltage pulse applied to a resistor varies, by varying the magnitude of the pulse or the width of the pulse, the volume of the ink drop ejected from the nozzle varies proportionately thereto. Lines 14, 16 are printed on paper 12 by applying voltage to selected ones of the resistors in the print cartridge as paper 12 moves therebeneath. Each of lines 14, 16 is made up of a plurality of rows of ink dots, each of which is ejected from one of the nozzles on the print cartridge, closely adjacent to one another so that a solid line is formed.

Figure 2:
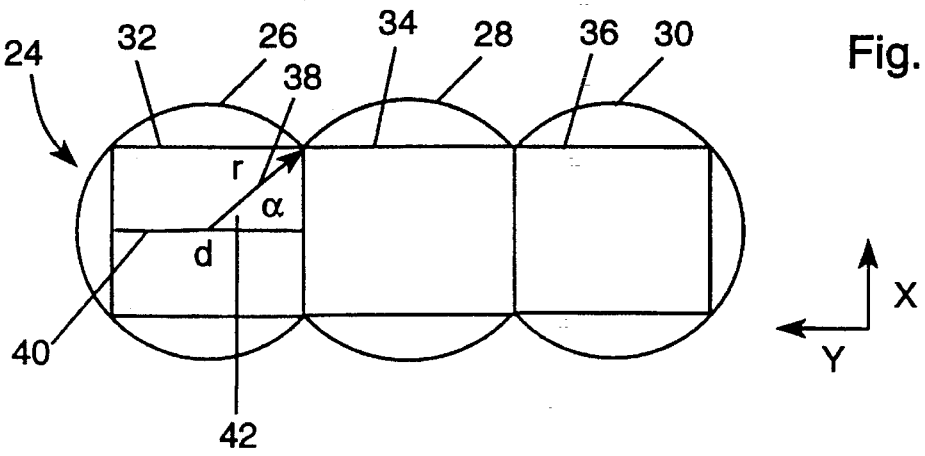
FIG. 2 is a highly enlarged diagrammatic view of three adjacent ink drops printed on paper by an ink-jet printer.
Figure 6:
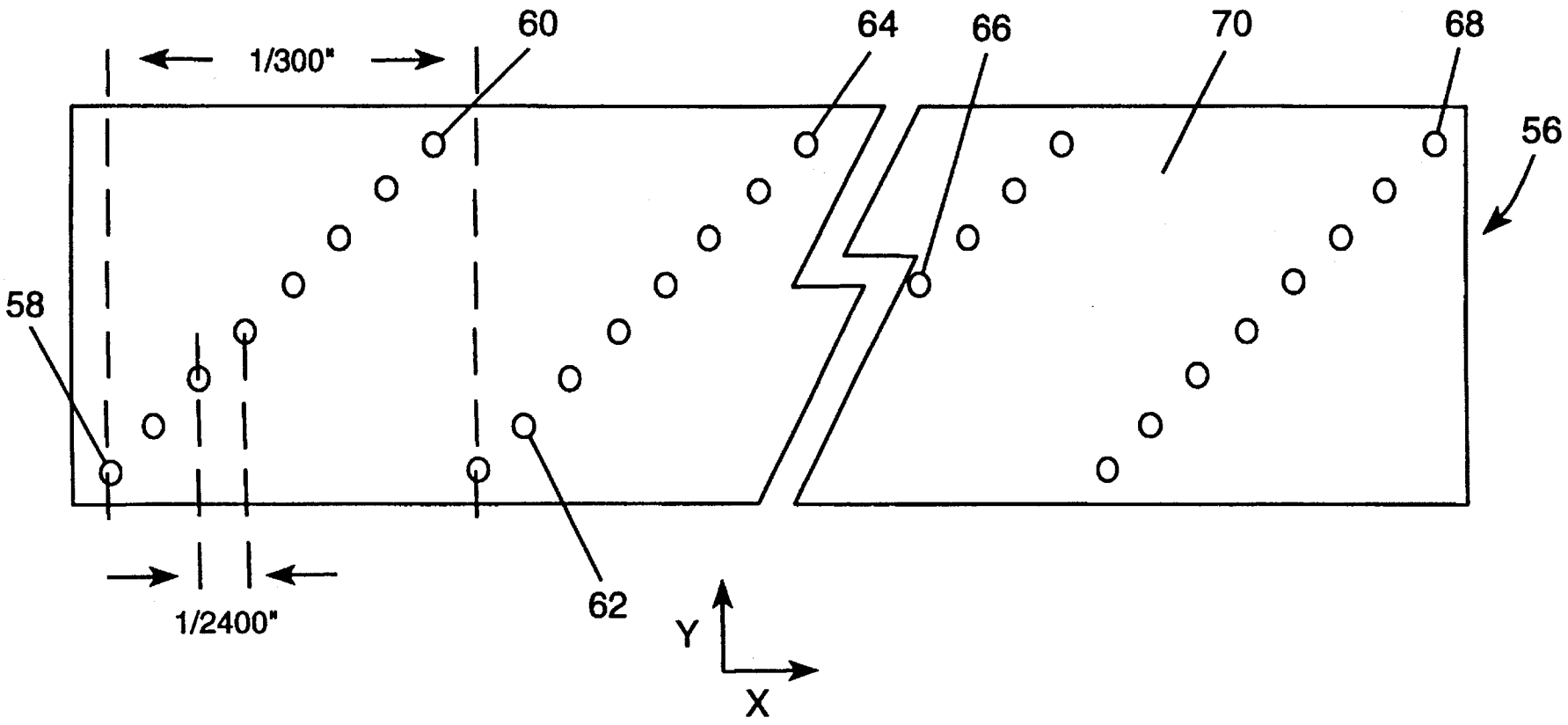
FIG. 6 is an enlarged plan view of an ink-jet print cartridge constructed in accordance with the present invention.

X and Y axes are illustrated for reference in FIGS. 1, 2 and 6. In each of the views, movement of print media is along the Y-axis as illustrated by an arrow 17 in FIG. 1. Lines 14, 16 are parallel to the X-axis.

An optical sensor 18 is like that disclosed in commonly assigned copending U.S. Pat. No. 5,289,208 issued Feb. 22, 1994 for AUTOMATIC PRINT CARTRIDGE ALIGNMENT SENSOR SYSTEM by Hasselby, which is incorporated herein by reference. Sensor 18 include diodes which can sense black-to-white transitions on paper 12. A person having ordinary skill in the art can easily use the disclosed techniques to create a circuit which generates a signal proportionate to the width of lines 14, 16 as detected by sensor 18. Such a signal is applied to a conductor 20 which is connected to optical sensor 18.

A Look-up Table 22 implements a function, f(LW), where LW is line width, in the present embodiment, the signal on conductor 20 proportionate to line width. Table 22 may be implemented in the form of a digital look-up table which those having ordinary skill in the art can implement. It is known that the drop volume (DV) of ink ejected from the nozzles in the print cartridge is a function of line width, i.e., DV=f(LW), where f(LW) is characteristic for a certain type of paper and ink. This relationship is more commonly stated $LW=f^{-1}(DV)$.

Figure 3:
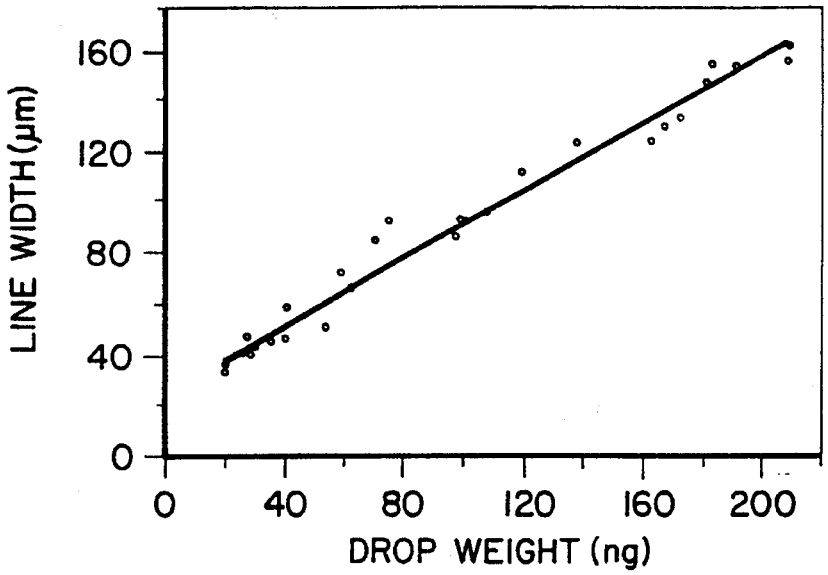
FIG. 3 is a plot of data points illustrating the relationship between line width and ink-drop weight for Gilbert Bond paper and illustrating a linear function fit.
Figure 4:
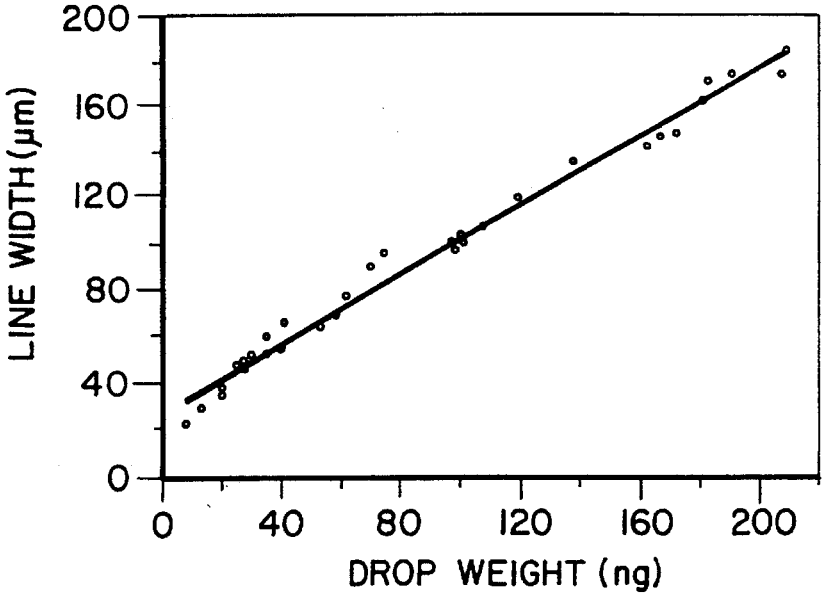
FIG. 4 is a plot similar to FIG. 3 for ink drops printed on a Mylar sheet.
Figure 5:
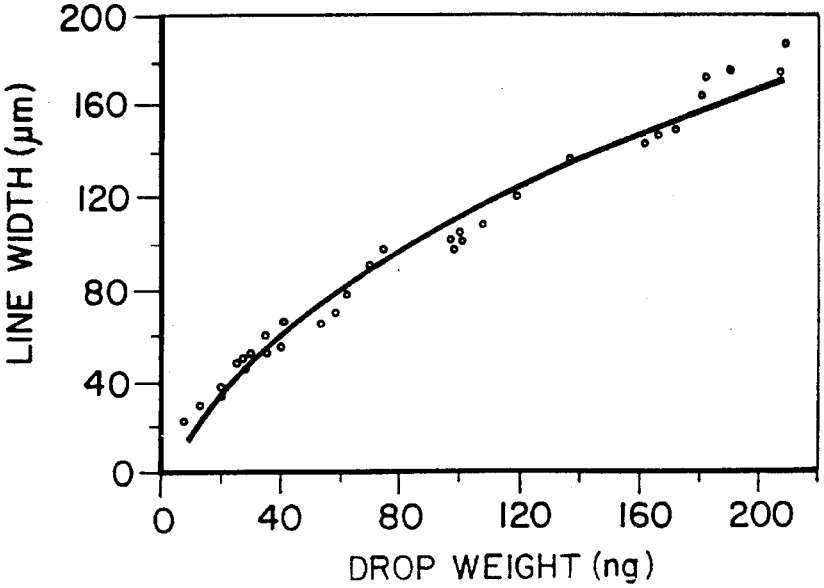
FIG. 5 is a plot illustrating the data from FIG. 4 but with a square-root volume curve fit.

This function is illustrated by empirical data set forth in FIGS. 3, 4 and 5. Turning first to FIG. 3, illustrated therein is a plot of data points collected for ink drop weight versus printer line width on Gilbert Bond paper. Thus, if paper 12 is Gilbert Bond the linear fit to the data points in FIG. 3 is the function implemented by Table 22. Although FIG. 3 depicts drop weight, for a given ink density, temperature and humidity, drop volume and weight are related with the linear fit of FIG. 3 expressed as a function of drop volume being as follows:

$$LW=0.657DV+25.58$$

This is the function implemented by Table 22. By way of example, FIGS. 4 and 5 each include the same data points for line width versus ink drop weight as applied to a polyamide sheet rather than to paper 12. FIG. 4 illustrates a linear fit and FIG. 5 illustrates a square-root volume fit to the data points. The FIG. 4 function is as follows:

$$LW=0.755DV+26.03$$

The FIG. 5 function is as follows:

$$LW=13.64DV^{1/2}-26.01$$

The type of print media and ink used, and to a lesser extent, the ambient temperature and humidity, thus determines the function in Table 22.

Turning now to FIG. 2, indicated generally at 24 is a highly enlarged, diagrammatic view of a portion of line 14 on paper 12 including three substantially circular dots 26, 28, 30 made by sequentially firing a single nozzle on the print cartridge three times as the paper moves along the Y-axis. It can be appreciated that the larger the volume of the ink drop ejected, the larger the diameter of each of dots 26, 28, 30.

For a printer with, e.g., 300 dot per inch (dpi) resolution, the size of each of the dots, like dots 26, 28, 30, printed on paper 12 must remain substantially constant for the resolution to be constant. As noted above, several factors can cause dot diameter to vary.

The spacing of ink-jet nozzles in the print cartridge along the X-axis corresponds to the desired printing resolution. Printer 10 in the present embodiment of the invention is a 300 dpi printer. Given the resolution, a minimum diameter for each of the printed dots, like dots 26, 28, 30, to achieve adequate area coverage can be calculated. Each of dots 26, 28, 30 includes a corresponding square 32, 34, 36 therein which is concentric with its corresponding dot. A radius line 38 is identified with the letter r to denominate the radius of dot 26. A line 40, denominated d is equal to each of the sides of square 32. A symbol α in dot 26 identifies angle 42 between lines 38, 40. The lines and squares are included in the depiction of the ink dots to illustrate the following calculation.

In order to be able to produce a completely covered area on a sheet a paper, d=1/dpi=1/300 inch for a 300 dpi printer. In addition, α=45° and line width (LW)=2r. It therefore follows:

$$\cos\alpha=\frac{(d/2)}{r}=\frac{d}{2r} \tag{1}$$

$$r=\frac{d}{2\cos\alpha}=\frac{d}{2\cos 45^\circ}=\frac{d(2)}{2\sqrt{2}}=\frac{d}{\sqrt{2}} \tag{2}$$

$$\text{Therefore, } LW=\frac{2(d)}{\sqrt{2}}=d\sqrt{2}=\frac{\sqrt{2}}{dpi} \tag{3}$$

For a 300 dpi printer then, $LW=\sqrt{2}/300=0.0047''=120$ microns (μm). Printer 10 maintains this line width, i.e., dot diameter, for a 300 dpi printer regardless of the actual drop volume required.

Returning again to FIG. 1, Look-up Table 22 includes an output applied to a conductor 44. It is to be appreciated that when Table 22 is implemented in digital form conductor 44 is a bus having a digital value thereon. Table 22 uses the LW signal on conductor 20 to create a signal on conductor 44 which is proportional to the drop volume (DV) of the dots in line 14 on paper 12. A conductor 46 is applied to one input of a comparator 48 which may be implemented in digital form. The other input of comparator 48 is connected to conductor 44. A signal level is applied to conductor 46 which is equal to the level of a signal on conductor 44 that produces the desired drop volume and therefore line width. Comparator 44 functions in the usual manner to place the difference between the signals on conductors 44, 46 on an output of the comparator which is applied to conductor 50.

Conductor 50 is connected to the input of a second Look-up Table 52. As previously mentioned drop volume (DV) is a function of the energy (E) of a voltage pulse applied to the resistor in each nozzle of the print cartridge. This can be expressed as DV=g(E) where g depends on the architecture of the print cartridge. Functions for the print cartridge in Shirohita et at. '762 are disclosed therein. The foregoing equation can also be expressed as $E=g^{-1}(DV)$. It is this latter function which is embodied in Look-up Table 52. Thus, an error signal appears on conductor 50 which represents the difference between the desired drop volume on conductor 46 and the actual drop volume on conductor 44. The error signal generates a signal on conductor 54, which is the output of the look-up table, proportional to the change in energy which, when applied to the resistors in the print cartridge, causes the line width, i.e., dot diameter, on paper 12 to approach the ideal line width represented by the value on conductor 46. The signal on conductor 54 is applied to the power supply (not shown) which controls the energy level of each pulse applied to the resistors in the print cartridge. The energy level can be varied either by varying the pulse width or the magnitude of each pulse.

In use, function f implemented by Table 22 is determined by performing a calibration run. In the calibration run, energy applied to the resistors in the print cartridge is increased in predetermined increments. Such increases produce a corresponding increase in LW. Because the function $g^{-1}$ is based on the print cartridge architecture it is relatively invariable and may be stored in a permanent memory in the circuit. The relationship between line width and drop volume, however, can vary dramatically depending upon the print media used in the printer. After such an energy run is made, values for the function f are calculated by a computer included in circuit 10 in a known manner and thereafter stored in a temporary memory. As the printer prints, sensor 18 periodically detects line width to permit the circuit to adjust the energy, if necessary, applied to the resistors to vary drop volume to maintain a constant dot diameter, i.e., line width. Such action during printing controls thermal and humidity effects on drop volume.

Figure 7:
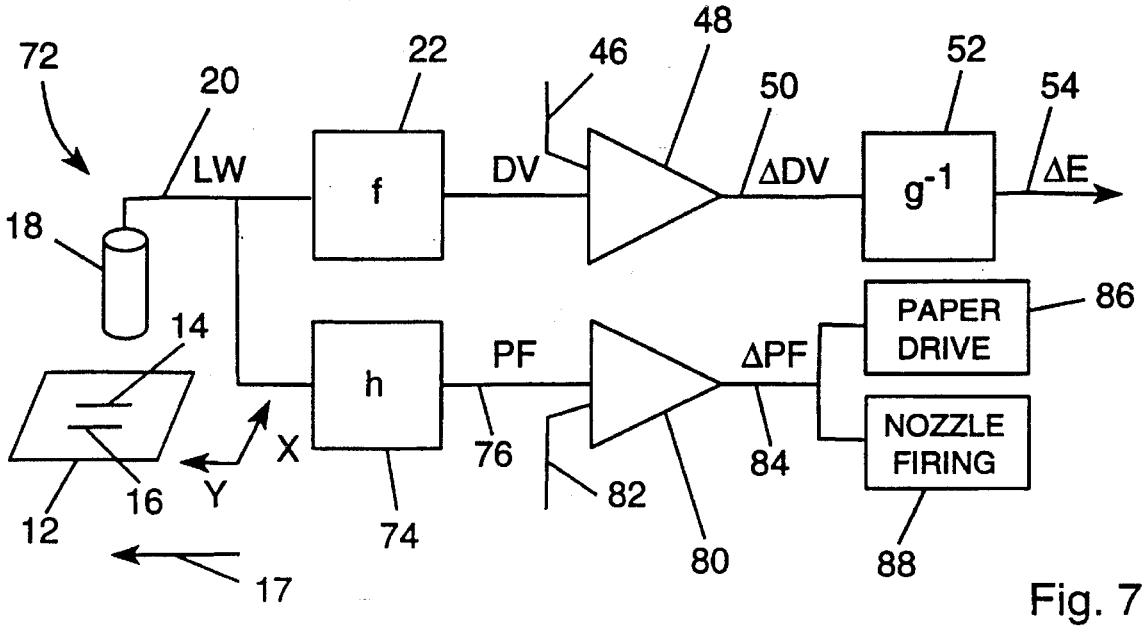
FIG. 7 is a schematic diagram of a portion of a second embodiment of the present invention.

Turning now to FIG. 6, indicated generally at 56 is a plan view of a print cartridge constructed in accordance with the present invention including a plurality of nozzles, like nozzles 58–68. The view of FIG. 6 is onto a surface 70 of cartridge 56 in which the nozzles are formed which is parallel to the paper during printing. Ink is ejected from each of the nozzle openings shown in FIG. 6 to form dots on the paper. Each of the nozzles is spaced 1/2400 of an inch from the next adjacent nozzle along the X-axis. Every eighth nozzle is thus spaced 1/300 inch from one another and lie along the same axis parallel to the X-axis, e.g., nozzles 60, 64. Like the cartridge utilized in printer 10, cartridge 56 includes resistors in each nozzle which vary the volume of an ink drop ejected from the nozzle proportionate to the energy applied to the nozzle resistor. It should be appreciated that the cartridge is not capable of 2400 dpi resolution because the nozzle and resistor size and design are geared to print dots much larger than that required for 2400 dpi resolution. In other words, dots printed by adjacent nozzles would substantially overlap one another. Turning now to FIG. 7, indicated generally at 72 is a second printer constructed in accordance with the present invention. Structure previously identified in connection with printer 10 retains the same numeral in FIG. 7.

In the embodiment of FIG. 7, the LW signal on conductor 20 is supplied to another look-up table 74. Look-up table 74 relates line width to printing frequency (PF). In other words, if a printer's optimum resolution is, e.g., 300 dpi, but because of limitations on the power supply firing the resistors or because of paper type, temperature or humidity, the minimum dot size printable is 135 μm dot placement is varied by varying the spacing of the dots in both the X and Y axes. This maintains resolution by maintaining the relative position of printer dots as shown in FIG. 2 rather than permitting excessive dot overlap or excessive spacing between dots. The function of look-up table 74 relates the line width to a printing frequency as described hereinafter.

First, with reference to FIG. 6, it will be recalled that in a 300 dpi printer a minimum line width of LW= $\sqrt{2}$/dpi=120 μm is required. If for example, sensor 18 detects a line width of 135 μm, and the signal on conductor 54 is driving the power supply at its lowest level, further compensation is not possible.

Given that dot size, as detected by sensor 18, has grown to 135 μm, the ideal dpi for this dot size is calculated as follows:

$$dpi(PF) = \frac{\sqrt{2}}{LW} = \frac{\sqrt{2}}{135\ \mu m} = 266.1\ dpi \tag{4}$$

It is Equation 4 which is implemented in look-up table 74. The result is applied to a conductor 76 and denominated PF for printing frequency. Conductor 76 is applied to one input of a comparator 80 with the other input thereof being applied to a conductor 82 which has applied thereto a value proportionate to the current printing frequency of the printer as will be described hereinafter. The output of comparator 80 which is the difference between the desired and current print frequencies is applied to conductor 84 which in turn is applied to an input of paper drive circuitry 86 and of nozzle firing circuitry 88.

Nozzle firing circuitry 88 controls the timing of the firing of ink drops from each of the nozzles in print cartridge 56. Such circuitry can be implemented with techniques and circuits disclosed in commonly assigned copending U.S. patent application Ser. No. 07/786,326 filed on Oct. 31, 1991 for FAST FLEXIBLE PRINTER/PLOTTER WITH THETA Z CORRECTION by Chin, Corrigan and Hasselby, incorporated herein by reference.

Given the desired dpi, i.e, printing frequency (PF) calculated in Equation 4 above, the nozzle spacing of print cartridge 56 which implements this dpi is calculated as follows:

$$\text{nozzle spacing} = \frac{\text{addressable nozzles}}{dpi_{desired}} = \frac{2400}{266.1} = 9 \tag{5}$$

Therefore every ninth nozzle in print cartridge 56, i.e., nozzles 58, 62, 66, 68, etc. is caused to fire by circuitry 88. This information is supplied to conductor 82, which is the current print frequency. This circuitry can compensate for vertical displacement of the nozzles and make nozzle firing occur on a virtual horizontal line parallel to the X-axis.

The foregoing computation which adjusts the dpi along the X-axis maintains a desired line width in the X direction. Adjustment must also be made to maintain a correct line within the Y direction. If each nozzle has an operating frequency of 3.6 kilohertz, then paper movement, i.e., movement along the Y-axis can be calculated as follows:

$$\text{Because: Velocity} = \frac{\text{distance}}{\text{Time}} \tag{6}$$

$$\text{If: Distance} = 1\ \text{dot} = \frac{1}{dpi}$$

$$\text{Then: Time} = \text{Period} = \frac{1}{\text{freq.}}$$

-continued $$\text{Thus: Velocity} = \frac{1}{\frac{dpi}{\frac{1}{\text{freq.}}}} = \frac{\text{freq.}}{dpi}$$

At the ideal of 300 dpi, velocity=3600 hertz/300 dpi=12 inches per 30 second (ips). For the above example in which the desired dpi is 266.1:

$$\text{Velocity} = \frac{3600\ \text{Hz}}{266.1\ dpi} = 13.53\ ips \tag{7}$$

To match the X-axis dpi (2400 dpi/9 nozzles=266.7 dpi, the following equation is used:

$$\text{Velocity} = \frac{3600\ \text{Hz}}{266.7\ dpi} = 13.5\ ips \tag{8}$$

Using the same dpi in both X and Y-axis is important to insure square images.

Thus, for printer 72, the signal on conductor 54 controls the power supply energy applied to each nozzle resistor to reduce line width adjustment within a predetermined range. This controls dot size to maintain resolution. Control of paper drive circuit 86 and nozzle firing circuit 88 via look-up table 74 can produce additional density adjustment as described above. It should be appreciated that the scheme implemented by look-up table 74 could be used on its own, i.e., without corresponding tables 22, 52, to vary print density in a printer. Thus, the present invention regulates print density in an ink-jet printer responsive to variations in temperature, humidity and print media used in the printer in a manner which maintains resolution either by changing dot size or the relative location of the printed dots.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

We claim:

1. A method for regulating print density in a printer having a plurality of nozzles which are each associated with a resistor that causes an ink drop to be fired from an associated nozzle responsive to voltage applied thereto, said method comprising the steps of:

selecting a predetermined line width;

positioning print media opposite said nozzles;

applying energy to the resistor associated with each of said nozzles in increasing predetermined increments during a calibration run so as to produce a plurality of calibration lines having correspondingly increasing line widths;

sensing widths of the calibration lines;

calculating a relationship between the widths of the calibration lines and ink-drop volume;

storing the relationship in the printer;

printing a line on the print media by applying a voltage pulse to the resistor of selected ones of each of said nozzles;

sensing a width of the printed line;

determining a difference between the predetermined line width and the printed line width; and varying, in response to the difference determination, a density of ink printed on the print media in accordance with the stored relationship so as to maintain resolution.

2. The method of claim 1 wherein the step of varying the density of ink printed on the print media in accordance with the stored relationship so as to maintain resolution comprises the step of varying an energy of a second voltage pulse applied to the resistor associated with each of the plurality of the nozzles.

3. The method of claim 2 wherein said method further includes the step of calculating an ink-drop volume necessary to produce a printed line having the sensed width.

4. The method of claim 3 wherein the step of determining the difference between the predetermined line width and the printed line width comprises the step of comparing the calculated ink-drop volume with an ink-drop volume necessary to print a line having the predetermined width.

5. The method of claim 1 wherein the step of calculating a relationship between widths of the calibration lines and ink-drop volume performing a linear fit on the widths of the calibration lines.

6. The method of claim 3 wherein said method further includes the step of calculating the voltage pulse energy necessary to produce a calculated ink-drop volume.

7. The method of claim 6 wherein said method further includes the step of determining a relationship between voltage pulse energy applied to said resistors and a volume of ink-drops fired from said nozzles.

8. The method of claim 1 wherein the step of varying the density of ink printed on the print media in accordance with the stored relationship so as to maintain resolution comprises the steps of:

moving the print media beneath the nozzles along a media scan axis; and varying a rate of print media movement 9 as to maintain resolution along the media scan axis.

9. The method of claim 8 wherein said method further comprises the step of calculating a rate of print media movement necessary to produce a printed line having the sensed width.

10. The method of claim 9 wherein the step of determining the difference between the predetermined line width and the printed line width comprises the step of comparing the calculated rate of print media movement with a rate of print media movement necessary to print a line having the predetermined width.

11. The method of claim 10 wherein said method further includes the step of determining a relationship between rate of print media movement and the width of a printed line.

12. The method of claim 1 wherein the step of varying the density of ink printed on the print media in accordance with the stored relationship so as to maintain resolution comprises a step of varying a spacing between nozzles used to print on the print media.

13. The method of claim 1 wherein the step of calculating a relationship between widths of the calibration lines and ink-drop volume performing a square-root fit on the widths of the calibration lines.

14. Apparatus for regulating printer density in a printer comprising:

a plurality of nozzles arranged to print rows of dots;

a resistor associated with each nozzle, said resistor causing an ink drop to be fired from an associated nozzle responsive to voltage applied to the resistor;

means for moving print media along a media scan axis beneath said nozzles;

means for selecting a predetermined line width;

means for applying energy to the resistor of selected ones of each of said nozzles in increasing predetermined increments during a calibration run so as to produce a plurality of calibration lines having correspondingly increasing line widths;

a sensor for sensing widths of the calibration lines printed on the print media;

means for calculating a relationship between the widths of the calibration lines and ink-drop volume;

means for storing the relationship in the printer;

means for printing a line on the print media;

means for determining a difference between the predetermined line width and the width of such a printed line; and means for varying a density of ink printed on the print media responsive to the difference determined by the means for determining and in accordance with the stored relationship so as to maintain resolution.

15. The apparatus of claim 14 wherein said means for varying the density of ink printed on the print media in a manner which tends to maintain resolution comprises means for varying a energy of the voltage pulses applied to the resistors.

16. The apparatus of claim 14 wherein said means for varying the density of ink printed on the print in a manner which tends to maintain resolution comprises means for varying a rate of print media movement so as to maintain resolution along the media scan axis.

17. The apparatus of claim 14 wherein said means for varying the density of ink printed on the print media in a manner which tends to maintain resolution comprises means for varying a spacing between nozzles used to print on the print media.

18. The apparatus of claim 17 wherein said means for varying the spacing between nozzles comprises a printhead having a plurality of selectively actuatable nozzles formed therein.

* * * * *